US005471374A

United States Patent [19]

Palmer

[11] Patent Number: 5,471,374

[45] Date of Patent: Nov. 28, 1995

[54] ILLUMINATOR BRACKET FOR A NIGHT VISION DEVICE

[75] Inventor: Gary L. Palmer, Vinton, Va.

[73] Assignee: ITT Corporation, New York, N.Y.

[21] Appl. No.: 215,512

[22] Filed: Mar. 22, 1994

[51] Int. Cl.[6] ..... F21L 15/04

[52] U.S. Cl. ..... 362/191; 362/253; 362/293; 362/427; 250/330

[58] Field of Search ..... 250/330, 493.1, 250/504 R; 362/3, 7–9, 11, 16, 18, 110, 190, 191, 259, 293, 253, 418, 427

[56] References Cited

U.S. PATENT DOCUMENTS

| | | | |
|---|---|---|---|
| 2,236,736 | 4/1941 | Scott | 362/110 |
| 2,610,262 | 9/1952 | Cunningham | 362/191 |
| 3,252,393 | 5/1966 | Stellrecht et al. | 362/9 |
| 3,999,055 | 12/1976 | Wakahara et al. | 362/3 |
| 4,112,300 | 9/1978 | Hall, Jr. et al. | 250/330 |
| 4,392,183 | 7/1983 | Ostlund et al. | 362/11 |
| 4,521,831 | 6/1985 | Thayer | 362/191 |
| 4,697,226 | 9/1987 | Verdin | 362/110 |
| 4,707,595 | 11/1987 | Meyers | 250/504 R |
| 4,916,579 | 4/1990 | Simms | 362/259 |
| 5,014,171 | 5/1991 | Price, III | 362/293 |

FOREIGN PATENT DOCUMENTS

| | | | |
|---|---|---|---|
| 1269742 | 6/1968 | Germany | 250/330 |
| 945329 | 12/1963 | United Kingdom | 250/330 |

OTHER PUBLICATIONS

Varo Inc. Electronic Products Div., "Infrared Viewer Mini–scope Model 5500", Mar./1963, 1 page.

*Primary Examiner*—Ira S. Lazarus
*Assistant Examiner*—Alan B. Cariaso
*Attorney, Agent, or Firm*—Arthur L. Plevy; Patrick M. Hogan

[57] ABSTRACT

The present invention is a bracket for coupling an illuminating device having an independent power supply to a night vision device having a separate power supply, wherein the illuminating device coupled to the housing of the night vision device will draw no additional power from the night vision device. The bracket comprises a generally cylindrical barrel for receiving the illuminating device, which may be a flashlight. A support extends substantially perpendicularly from the cylindrical barrel near one end. An eye ring is included on the support for attaching the bracket to a housing. The support further includes a second support region extending from the cylindrical barrel to just above the eye ring, wherein the support region overhangs a portion of the housing of the night vision device to provide additional support. The bracket is rotably positionable on the housing in an arcuate path between first and second points, allowing the flashlight to be moved from side to side to accommodate both left-handed and right-handed users. A second preferred embodiment of the bracket includes a longitudinal slit through the cylindrical barrel, wherein the barrel is expandable to accommodate flashlights of different sizes.

21 Claims, 4 Drawing Sheets

ILLUMINATOR BRACKET FOR A NIGHT VISION DEVICE

RELATED APPLICATIONS

The assignee herein, ITT Corporation, is the record owner of U.S. patent application Ser. No. 08/152,193, entitled MONOCULAR NIGHT VISION DEVICE, filed by the present inventor herein on Nov. 12, 1993 and ITT Corporation is also record owner of U.S. design patent application Ser. No. 29/014,252, entitled NIGHT VISION MONOCULAR, filed by the present inventor herein on Oct. 15, 1993.

FIELD OF THE INVENTION

The present invention relates to night vision devices, and more specifically, to a bracket adapted to hold an infrared illuminating device which is used in conjunction with night vision equipment.

BACKGROUND OF THE INVENTION

Night vision devices are widely used in the military to provide soldiers, aviators and sailors with the ability to view objects at night or during other low light conditions. As of late, with the advent of less complicated and .more affordable designs, night vision devices have also become available to the general public. These publicly available consumer night vision devices have a tremendous range of applications including night marine piloting, underwater vision, night security, surveillance, hunting, fishing, navigation and other such night-related or low light activities.

Examples of consumer-oriented night vision devices and the technology associated therewith can be found in U.S. patent application Ser. No. 08/152,193, entitled MONOCULAR NIGHT VISION DEVICE filed on Nov. 13, 1993 and U.S. design patent application Ser. No. 29/014,252, entitled NIGHT VISION MONOCULAR, filed on Oct. 15, 1993, both of which applications are assigned to the ITT Corporation, the assignee herein and filed by the present inventor herein. Each of the applications relates to monocular night vision devices; other examples of consumer night vision equipment can be found in U.S. patent application Ser. No. 08/108,989 entitled NIGHT VISION BINOCULARS filed on Aug. 18, 1993 and U.S. patent application Ser. No. 07/954,006 entitled CONSUMER NIGHT VISION APPARATUS, filed on Sep. 30, 1992, both of which applications are assigned to the ITT Corporation, the assignee herein.

Night vision devices typically include an image intensifier tube that converts infrared energy into visible light. Such night vision devices typically require sophisticated power supplies and circuitry to control the operation of the image intensifier tube and sophisticated optical arrangements that direct infrared energy into the image intensifier and direct visible light away from the image intensifier. Thus, night vision devices are primarily image intensifiers having a response curve that peaks at near-infrared light wavelengths.

One problem associated with night vision equipment is that, in many situations, particularly during dead-of-night activities, there is often an insufficient near-infrared image available from objects on the ground to make maneuvering and navigation possible by means of the night vision device. Shadows and other dark regions which a night vision device user may encounter will also present a problem.

To solve this problem, it is known that an object can be illuminated by a beam of near-infrared light in the same manner as illuminating an object with visible light. So too can shadows and other dark regions be illuminated with a beam of near-infrared light. As such, the near-infrared light beam and the near-infrared light reflected from the object or dark region will be visible to users of the night vision equipment, but will be invisible to the naked eye.

Unfortunately, the solution to the problem of nighttime illumination is not as simple as providing the night vision user with a near-infrared spotlight. This is because the night vision device user, especially in the case of a portable night vision device, will already have at least one of his hands busy with the operation of the night vision device. Chances are the user will require the use of his other hand for accomplishing some other activity, be it stabilization, or operation of another device related to the night viewing task. Thus, a solution is necessary in order that the free hand or hands of the night vision user need not be concerned with an additional activity of focusing the near infrared beam on the dark objects or regions. Moreover, the task of turning an illuminator on and off presents problems in its own rite. That is, activation of an illumination device by a traditional slide switch means requires additional hand manipulations that are usually undesirable.

Another obstacle to supplying night vision illumination is that the power supplies associated with night vision equipment typically cannot accommodate the power drain of an additional device, such as, an infrared illuminator. Image intensifier tubes and control circuitry associated with most types of night vision devices consume power at a fairly rapid rate. This is especially true of portable night vision devices that are battery powered, wherein it is desirable to reduce the draw on the internal battery, so as to maximize night viewing operation and minimize the costs and inconveniences of battery replacement and/or recharging. Accordingly, an illuminating device which draws power from the battery of a night vision device and hastens the depletion thereof is both undesirable and impractical.

It has been suggested in the prior art to use near-infrared laser diodes to act as a spotlight for night vision devices. High power laser diodes have the advantage of being able to produce a relatively bright and concentrated beam, which can be used to illuminate objects at a great distance with near infrared light. A disadvantage of these laser diodes is that they tend to consume a great deal of power and most importantly, the beams produced from laser diodes can be bright enough to harm unprotected eyes at both close and medium ranges. Thus, it can be extremely dangerous to equip night vision devices with high power laser diodes as a source of near-infrared illumination, especially in the case of hand held night vision equipment adapted for consumer use.

It is therefore an objective of the present invention to provide a means for attaching an infrared light source to a night vision device, such that the user need not be concerned with using his or her free hands to operate and focus the light source. It is an additional object of the present invention to reduce the hand manipulations involved in the activation and deactivation of a near infrared light source.

It is further an object of the present invention to provide a means for adapting a near infrared light source to a night vision device, wherein the power drain to the internal battery of the night vision device is eliminated. It is additionally an objective of the present invention to provide a means for attaching a near infrared light source to a night vision device, wherein the light source is not harmful to the naked eye. It is also an object of the present invention to accomplish the above objectives in a cost effective and simplified manner.

SUMMARY OF THE INVENTION

The present invention is a bracket for coupling an illuminating device having an independent power supply to a night vision device having a separate power supply, wherein the illuminating device coupled to the housing of the night vision device will draw no additional power from the night vision device. The bracket comprises a generally cylindrical barrel for receiving the illuminating device, which may be a flashlight. The flashlight, equipped with a removable infrared filter can be selectively removed from the cylinder for conventional illumination uses. A support extends substantially perpendicularly from the cylindrical barrel near one end. An eye ring is included on the support for attaching the bracket to a housing. The support further includes a second support region extending from the cylindrical barrel to just above the eye ring, wherein the support region overhangs a portion of the housing of the night vision device to provide additional support. The bracket is rotably positionable on the housing in an arcuate path between first and second points, allowing the flashlight to be moved from side to side to accommodate both left-handed and right-handed users.

A second preferred embodiment of the bracket includes a longitudinal slit through the cylindrical barrel, wherein the barrel is expandable to accommodate flashlights of different sizes.

BRIEF DESCRIPTION OF THE FIGURES

For a better understanding of the present invention, reference may be had to the following description of an exemplary embodiment thereof, considered in conjunction with the accompanying drawings, in which.

DETAILED DESCRIPTION OF THE DRAWINGS

Figure 1:
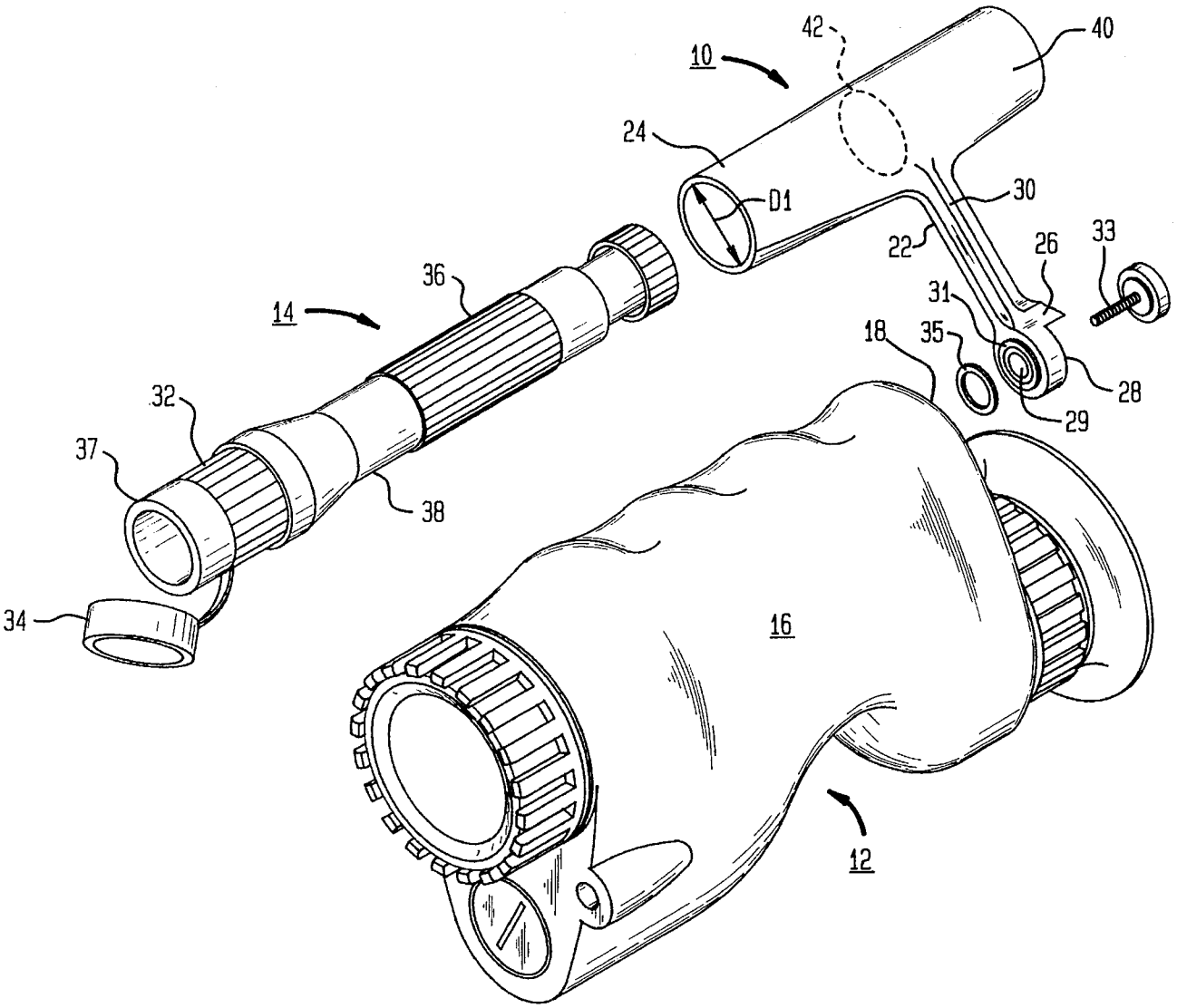
FIG. 1 shows a perspective view of one preferred embodiment of the present invention bracket, shown in conjunction with a monocular night vision device and an illuminating means.

Referring to FIG. 1 there is shown one preferred embodiment of the present invention illuminator bracket 10. The present invention bracket 10 is shown in conjunction with a monocular night vision device 12 and a flashlight 14 which can act as a night vision illumination device. Although the present invention bracket 10 is shown as used with the monocular night vision device 12, it will be understood that the illuminator bracket may be used with any night vision device and that use with the monocular night vision device as shown in FIG. 1, illustrates only one preferred embodiment. The specific workings and details concerning the monocular night vision device are set forth in U.S. patent application Ser. No. 08/152,193, entitled MONOCULAR NIGHT VISION DEVICE, filed by the present inventor herein on Nov. 12, 1993 and U.S. design patent application Ser. No. 29/014,252, entitled NIGHT VISION MONOCULAR, filed by the present inventor herein on Oct. 15, 1993. Both applications are assigned to the ITT Corporation, the assignee herein, and are incorporated by reference herein.

The present invention bracket is shown in conjunction with the monocular night vision device 12, wherein the night vision device is contained within a shock absorbent housing 16 comprised of a resilient material. The illuminator bracket 10 is mounted on a rearward portion 18 of the housing 16 of the night vision device 12, above a viewing eyepiece 20. The illuminator bracket 10 is generally an L-shaped member having a receiving cylinder 24 for accepting an illuminating device and a support stem 22 which protrudes in a generally perpendicular manner from one end of the cylinder 24. A lower portion of the support stem 22 includes a hood 26 and an eye ring 28 which extends below the hood 26. A mounting aperture 29 is included within the eye ring 28, wherein an annular protrusion 31 surrounds the mounting aperture. The annular protrusion 31 prevents deformation of the bracket 10 during mounting to the housing 16. The bracket 10 is secured to the housing 16 of the night vision device 12 in a conventional manner, for example, using a screw 33 and washer 35. The shown embodiment of the bracket 10 includes a reinforcing rib 30 within the support stem 22 for structural reinforcement purposes. A bottom portion of the cylinder 24 is tapered from the front end into the support stem 22 to provide frontal stability.

The bracket 10 is preferably injection molded from a strong but lightweight plastic material, such as that used for the housing 18. In this way little additional weight is added to the night vision device when the bracket 10 is coupled thereto. An example of such a plastic material is XENOY® PC/PBT resin alloy, a thermoplastic material supplied by the General Electric Company via the GE Plastics Division. Polyester bond urethanes and polycarbonates have also been found to be suitable materials for forming the present invention bracket 10. It will be understood, however, that the bracket may be comprised of any other material capable of supporting an illumination device, including various metals, such as die cast aluminum.

As can be seen from FIG. 1, the receiving cylinder 24 is adapted to accept and hold the flashlight 14. The receiving cylinder 24 shown has an interior diameter D1 of approximately 0.75", so as to accommodate many popular brands of miniature flashlights on the market today. Examples of commercially available miniature flashlights suitable for the present application are the Legend flashlights manufactured by the Keller Company, a Division of the Brinkman Corporation of Dallas, Texas. It will be understood that the receiving cylinder 24 may of any diameter to accommodate various flashlight body sizes, for example in the range 0.35" through 1.5". The flashlight 14 will have an adjustable lens mechanism 32 so as to alter the beamwidth emanating from the light source. The flashlight can be equipped with a removable infrared filter 34 which converts the white light from the flashlight into the infrared spectrum. The infrared filter 34 can take the form of a hinged cap that can be easily manipulated over the bulb end 37 of the flashlight. In this way, the flashlight can act as an infrared illuminator for the night vision device 12, when the filter is in place, and as a conventional white light flashlight when the filter is removed. Alternately, a infrared bulb, low power laser diode, or other infrared light producing means can be installed in the flashlight to eliminate the need for an infrared filter.

The flashlight 14 is battery powered, for example, by means of two AA size batteries or two AAA batteries in a smaller size flashlight. Since the illuminating means, which in this case is flashlight 14, is internally powered, there need not be any electrical connections running between the night vision device 12 and the flashlight 14. This arrangement has many advantages, the most significant being that no additional current drain is placed on the internal battery of the night vision device 12, thereby allowing the battery to last longer. Accordingly, the present invention illuminator bracket 10 allows for enhanced night vision viewing without increasing the load and depletion rate of the battery in the night vision device 12. A further advantage is that the flashlight 14 can be removed from the bracket 10 and the infrared filter 34 disconnected in order that a night vision user can use the flashlight in a conventional manner to illuminate the user's movements. Another advantage in having the flashlight 14 internally powered is that both the flashlight and night vision device can remain self-contained, thereby reducing the likelihood of damage to internal components from exposure to hostile outside elements.

From FIG. 1, it can be seen that the flashlight 14 contains a raised portion 36 located midway along the barrel 38 thereof. The raised portion 36 on the barrel 38 will be made of a deformable elastomeric material. Placement of the barrel 38 of the flashlight 14 into the receiving cylinder 24 forms an interference fit between the raised portion 36 of the flashlight 14 and the interior of the cylinder 24. A rear end 40 of the receiving cylinder 24 has a slightly smaller diameter D2 than the remainder of the cylinder 24, whereby a lip 42 is formed at the transition between the first interior diameter D1 and the second interior diameter D2. Accordingly, the barrel 38 of the flashlight 14 can be inserted only so far, until the raised portion 36 abuts the lip 42 of the cylinder 24. Abutment of the raised portion 36 of the flashlight barrel 38 against the lip 42 signifies optimal placement of the flashlight 14 for night vision illumination purposes. The lip 42 also prevents the flashlight 14 from falling out of the bracket 10.

Figure 2:
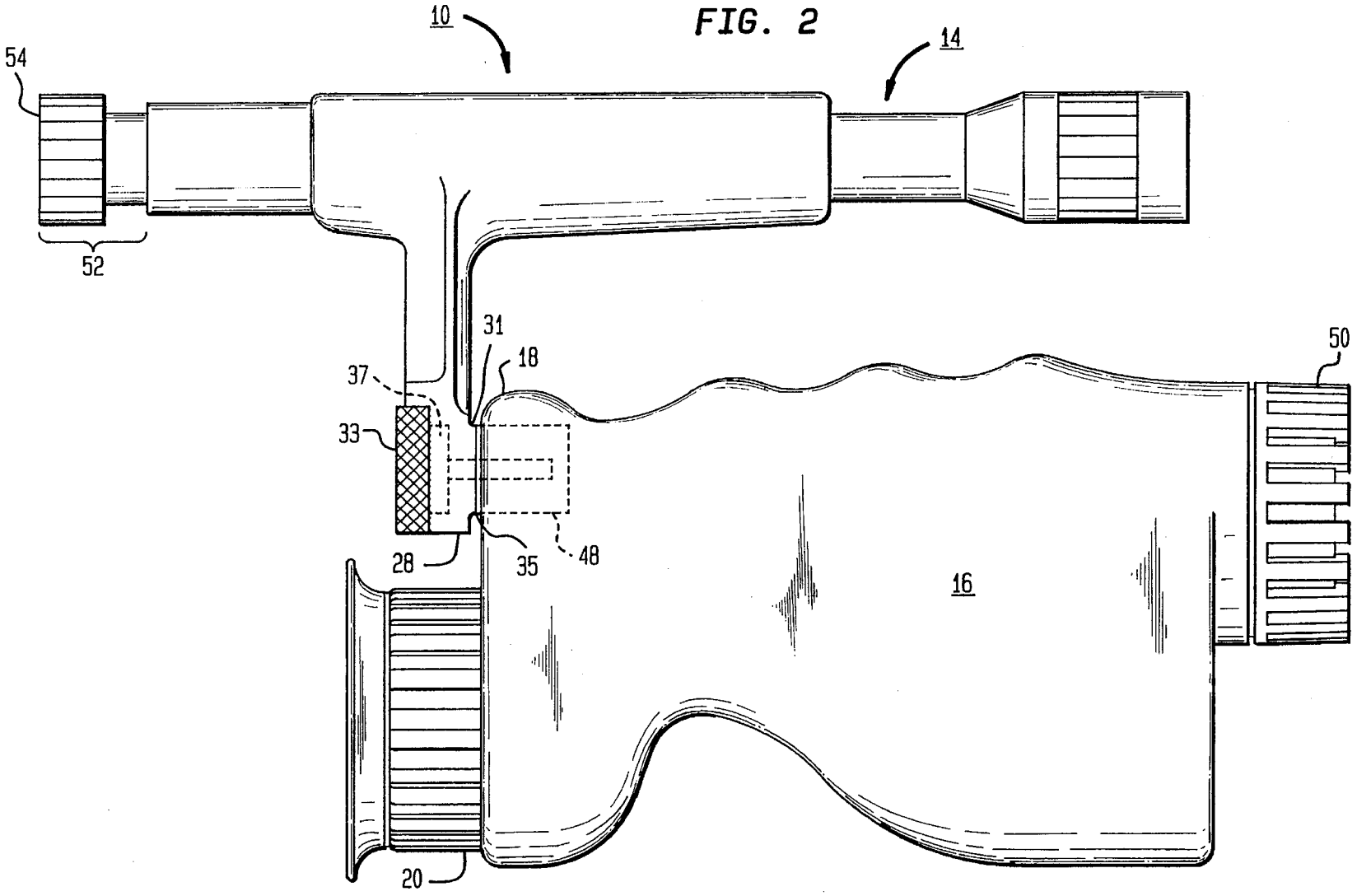
FIG. 2 shows a sideview of the present invention bracket as used in combination with a night vision device and illuminating device.

Referring to FIG. 2, there is shown a side view of the present invention illuminator bracket 10 as it is attached to the housing 16 of the night vision device 12. The bracket 10 mounts toward the rear 18 of the housing 16 above the viewer's eyepiece 20. The eye ring 28 of the bracket 10 is secured to the housing 16 in the eye ring area by means of a screw 33 or other conventional mounting means. The screw 33 passes through the mounting aperture 29 in the bracket 10 into an anchor 48 located within the body of the night vision device 12. The anchor 48 is adapted to receive the screw 33 and securely fasten the bracket 10 to the housing 16. A washer 35 can be used in between the annular protrusion 31 and the housing 16 when the bracket 10 is mounted, thereby preventing any deformation to the bracket 10. The eye ring 28 contains recess 37 in order that the screw 33 may be somewhat set within the eye ring 28. It can be seen that the hood 26 of the support stem 22 overhangs a portion of the screw 33 when the bracket 10 is mounted to the night vision housing 16. Thus, the hood 26 allows for easy adjustment of the screw while at the same time providing additional stability and support.

When the flashlight 14 is positioned within the receiving cylinder 24 as shown in FIG. 2, the near infrared light beam of the flashlight 14 is directed in essentially the same path as the output lens 50 of the night vision device 12. Accordingly, the flashlight 14 can be used to illuminate shadows and other dark regions in the viewing path, such that a suitable image can be observed with the night vision device 12. Although the infrared beam produced from the flashlight 14 is not as strong as that produced from other infrared illuminators, such as high power laser diodes, the beam of the flashlight is more than adequate for the applications of a consumer night vision device. Moreover, the flashlight beam does not present the same dangers to the naked eye as does a high power laser diode. This alone, makes the flashlight-type illuminator preferable for most consumer applications.

Looking more closely at the flashlight 14 contained within the bracket 10, it can be seen that a switch 52 is located at the butt end 54 thereof. The switch 52 is a spring operated pushbutton ON/OFF mechanism or other similar type switch for activating and deactivating the flashlight beam. The flashlight 14 is positioned within the bracket 10 so as to easily allow the user of the night vision device 12 to operate the flashlight without the use of his or her hands. A night vision user need only touch the butt end 54 of the flashlight 14 containing the switch 52 towards the forehead or other part of the body in order to turn the flashlight ON and OFF.

Figure 3:
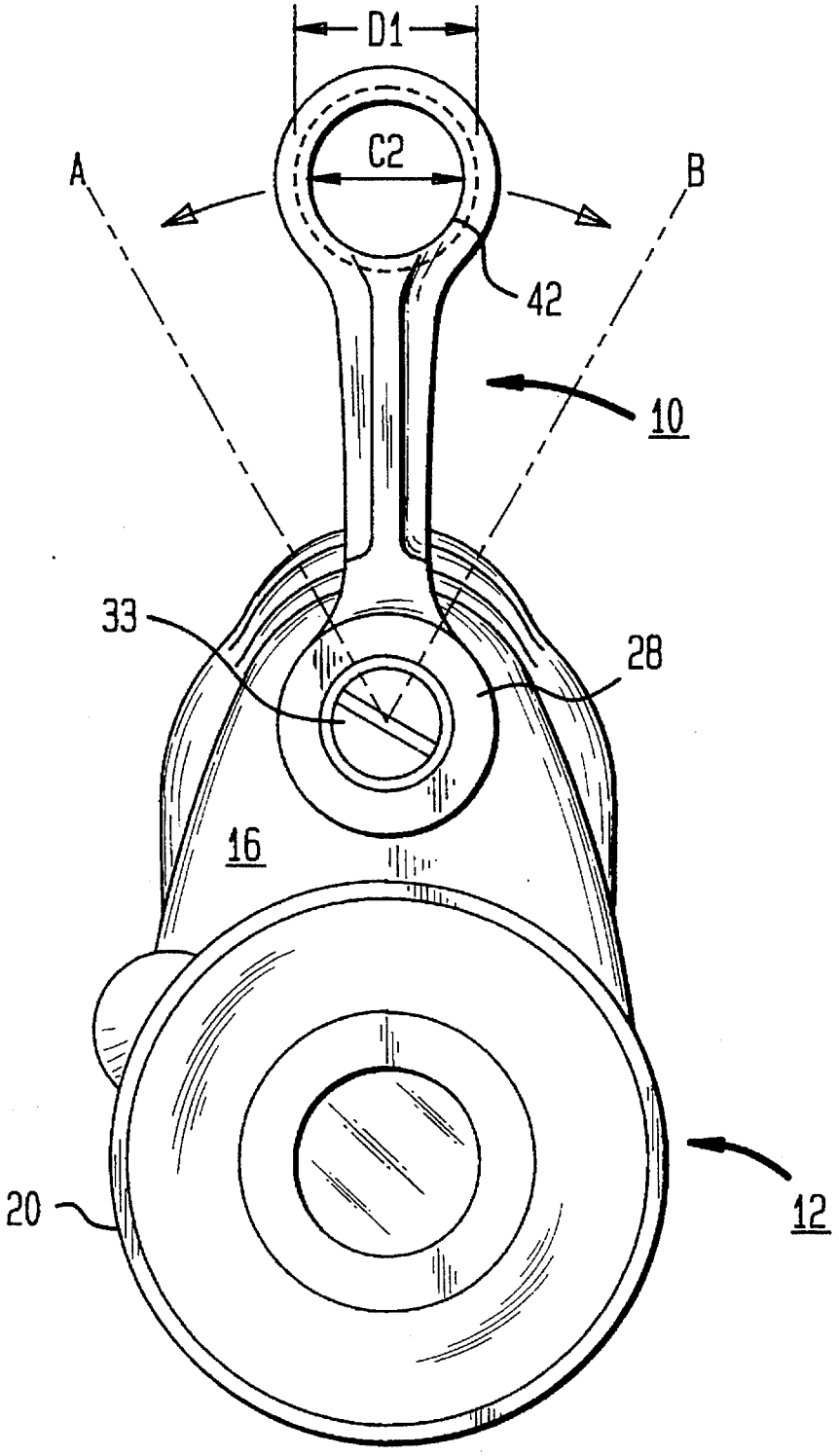
FIG. 3 shows a rear view of the present invention bracket as used in combination with a night vision device.

Referring to FIG. 3, a rearward view of the present invention illuminator bracket 10 is shown attached to the night vision device 12 (without the flashlight contained therein). FIG. 3 more clearly illustrates the mounting position of the bracket 10 on the housing 16 of the night vision device 12. The anchor (not shown) to which the eye ring 28 of the bracket 10 attaches, is symmetrically positioned above the eyepiece 20 at the top of the housing 16. Since the bracket 10 is mounted to the housing by means of a single screw 33, a pivotal rotation can be accomplished on the axis of the screw 33, whereby the bracket 10 can be moved in arcuate path, for example, as designated by points A and B. The swivelling feature of the bracket 10 is advantageous in order to allow for various positions of the flashlight 14 that may be more suitable for either a right-handed or left-handed viewer. The screw 33 can be tightened sufficiently at any position in order to prevent movement of the bracket 10. The head of the screw 33 is knurled in order to facilitate adjustment.

FIG. 3 also illustrates the two different inner diameters D1 and D2 of the receiving cylinder 24 of the bracket 10. As mentioned previously, the lip 42 which is formed in the transition region between diameters D1 and D2 acts to stop the forward progress of the flashlight barrel 38 once it is inserted in to the bracket 10.

Figure 4:
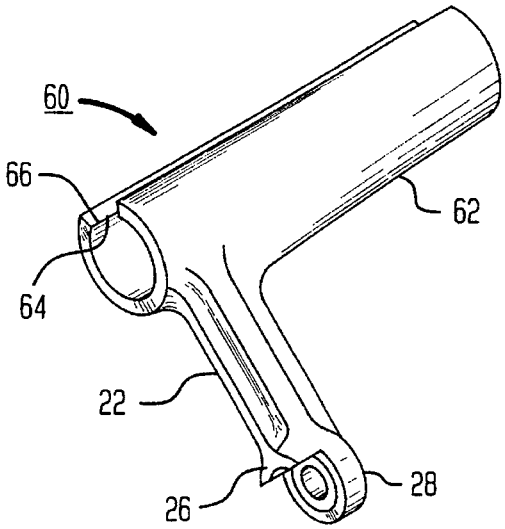
FIG. 4 is a perspective view a second preferred embodiment of the present invention bracket.

Referring to FIG. 4, there is shown a second preferred embodiment of the present invention bracket 60 from a rear perspective. Like numbers refer to like components in the first embodiment. As can be seen, the bracket 60 contains a receiving cylinder 62 having a single longitudinal slit 64 in a top portion thereof. The slit 64 in the receiving cylinder 62 allows for a slight expansion of the receiving cylinder, if need be. In this way, variable sizes of flashlight barrels can be accommodated. The receiving cylinder 62 has a nominal inner diameter of approximately 0.75", wherein a flashlight having a barrel diameter in the range of from 0.75" through 1.0" can be securely held within the cylinder 62. It will of course be understood that the receiving cylinder may be of any suitable diameter for different ranges of flashlight sizes. Once again the bracket will preferably be formed from a lightweight plastic material having some degree of flexibility in order to accommodate slight expansion. A lip 66 on the interior of the cylinder 62 will provide a stop to prevent overinsertion of a flashlight barrel. The bracket 62 will be mounted to a housing of a night vision device in the manner previously described.

Figure 5:
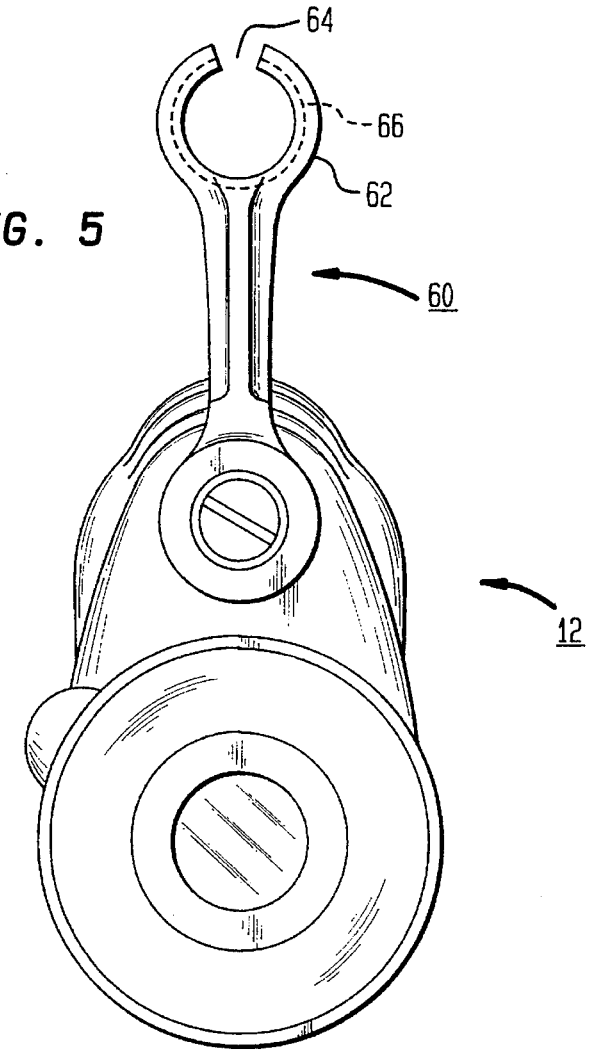
FIG. 5 is a rear view of the second preferred embodiment of the present invention bracket.

FIG. 5 illustrates a rear view of the bracket 60 as seen from the perspective of the night vision user. This view of the bracket clearly illustrates the slit 64 contained in the top of the receiving cylinder 62. As mentioned, the slit 64 allows for a degree of expandability in the receiving cylinder 62 in order to accommodate varying sizes of flashlights. The lip 66 is also clearly illustrated.

From the above, it should be understood that the embodiment described, in regard to the drawings, is merely exemplary and that a person skilled in the art may make variations and modifications to the shown embodiment without departing from the spirit and scope of the invention. All such variations and modifications are intended to be included within the scope of the invention as defined in the appended claims.

What is claimed is:

1. An apparatus for coupling an illuminating device having an independent power supply to a night vision device having a separate independent power supply and contained within a housing, said apparatus comprising:

support means for supporting and holding said illuminating device, said support means including a cylindrical member for receiving said illuminating device and a stem protruding from one end of said cylindrical member, said stem having a reinforcing rib member that projects from a surface of said stem to increase the stability thereof and mounting means thereon for attaching said apparatus to said housing of said night vision device, wherein said illuminating device is activatable to illuminate a field of view substantially in front of said night vision device, said illuminating device requiring no additional power consumption from said power supply of said night vision device.

2. The apparatus of claim 1, wherein said illuminating device includes a flashlight.

3. The apparatus of claim 1, wherein said mounting means includes an eyelet for pivotally attaching said apparatus to said housing of said night vision device.

4. The apparatus of claim 1, wherein said cylindrical member has an inner diameter between 0.35 and 1.5 inches.

5. The apparatus of claim 1, wherein said cylindrical member includes a annular lip on the interior surface thereof, wherein said flashlight is stopped by said lip after insertion into said cylindrical member.

6. The apparatus of claim 1, wherein said cylindrical member includes a longitudinal slit therethrough, said member being expandable to accommodate flashlight bodies having varying diameters.

7. The apparatus of claim 3, wherein said apparatus is rotable in an arcuate path between a first and second point, to allow adjustability of said illuminating device from side to side to thereby accommodate both left-handed and right-handed night vision viewers.

8. The apparatus of claim 1, wherein said night vision device is a monocular night vision device.

9. A bracket for coupling a flashlight having a removable infrared filter to a night vision device, said bracket comprising:

a longitudinal tubular member having a first and second end and having a stem emanating from the periphery thereof, said stem having means to pivotally couple said bracket to said night vision device, said means for pivotally coupling said bracket includes an eyelet, said stem further including a support member extending from said tubular member proximate said eyelet, wherein said support member has a section that overhangs a portion of a screw used to fasten said bracket to the night vision device to provide additional support, said tubular member being adapted to encircle a flashlight barrel of a given diameter, whereby said flashlight is insertable within said tubular member to direct infrared light and illuminate a field of view for said night vision device, said flashlight being selectively removable from said tubular member to be used for other illumination purposes.

10. The bracket of claim 1, wherein said bracket is rotatably positionable on night vision device in an arcuate path between first and second points, thereby allowing said flashlight to be moved from side to side to accommodate both left-handed and right-handed users.

11. The bracket of claim 9, wherein said tubular member includes a longitudinal slit therethrough, said member being expandable to accommodate flashlights of different sizes.

12. The bracket of claim 9, wherein said tubular member includes a first and second inner diameter, wherein said second inner diameter located at said second end is slightly smaller than said first inner diameter, said second inner diameter providing a stopping means to hold said flashlight in place within said tubular member.

13. An assembly for providing supplemental illumination to a night vision device of the type having an image intensifier tube, an objective lens, an ocular lens arrangement and an independent power supply contained within a housing, said assembly comprising:

illumination means having a separate power source from said night vision device;

bracket for holding said illumination means and attaching to said night vision device, said bracket including support means for supporting and holding said illumination means, said support means being attachable to said housing of said night vision device, said support means including a protruding stem having an eyelet for use with an adjustment screw for pivotally attaching said bracket to said night vision device, wherein said stem further includes a hood which overhangs a portion of said screw when said bracket is mounted to said housing to thereby increase stability of said bracket and allow adjustability of said screw, said illumination means being selectively operable to illuminate a field of view substantially in front of said night vision device without draining power from said power supply of said night vision device.

14. The assembly of claim 13, wherein said illumination means is a flashlight and said support means includes a tubular member for receiving said flashlight.

15. The assembly of claim 14, wherein said flashlight includes a removable infrared filter for converting white light to infrared light, said flashlight being selectively removable from said tubular member and said infrared filter being removable for conventional use of said flashlight.

16. The assembly of claim 14, wherein said flashlight includes an infrared light source.

17. The assembly of claim 14, wherein said tubular member extends rearward from said night vision device, and wherein said flashlight includes activation means located on the butt end thereof, said flashlight being activatable without the use of hands, by depressing said activation means in said butt end against a proximate body part.

18. The assembly of claim 14, wherein said tubular member includes a lip on the interior surface thereof and said flashlight includes a raised elastomeric portion on a surface thereof, wherein said lip provides a stop for said raised portion of said flashlight after insertion into said tubular member.

19. The assembly of claim 14, wherein said tubular member includes a longitudinal slit therethrough, said member being expandable to accommodate flashlight bodies having varying diameters.

20. The assembly of claim 14, wherein said bracket is rotatable in an arcuate path between first and second points, said illumination means being adjustably positionable to accommodate left-handed and right-handed night vision viewers.

21. The assembly of claim 13, further including a monocular night vision device.

* * * * *